United States Patent [19]

Trankle

[11] Patent Number: 4,880,152

[45] Date of Patent: Nov. 14, 1989

[54] PORTABLE TAPE DISPENSER UNIT

[76] Inventor: Richard Trankle, 2905 Druid Dr., Plano, Tex. 75075

[21] Appl. No.: 142,512

[22] Filed: Jan. 11, 1988

[51] Int. Cl.[4] ..... B65H 75/40

[52] U.S. Cl. ..... 224/162; 224/219; 224/255; 224/267; 242/96; 242/72 R; 83/649; 225/78

[58] Field of Search ..... 224/218, 219, 221–222, 224/267, 253, 162, 217, 255; 411/313, 314, 929.2, 544, 546, 907, 943; 24/3 A; 222/175; 221/185; 225/78; 83/649; 204/53, 54; 242/96

[56] References Cited

U.S. PATENT DOCUMENTS

| | | | |
|---|---|---|---|
| 1,025,400 | 5/1912 | Hugon | 411/544 X |
| 1,213,102 | 1/1917 | Hill | 24/3 A |
| 1,518,026 | 12/1924 | Van Sluys | 242/72 R |
| 1,818,514 | 8/1931 | Whitaker | 224/162 |
| 2,470,250 | 5/1949 | Kienle | 224/253 |
| 2,638,282 | 5/1953 | Prevost | 242/72 R |
| 3,217,955 | 11/1965 | Tinkey | 225/78 |
| 3,921,936 | 11/1975 | Suter | 224/219 X |
| 3,980,245 | 9/1976 | Delehoy | 242/96 |
| 4,069,954 | 1/1978 | Rauch | 224/901 X |
| 4,195,794 | 4/1980 | Ricci et al. | 242/96 |
| 4,289,061 | 9/1981 | Emmett | 411/544 X |

*Primary Examiner*—Linda J. Sholl

*Attorney, Agent, or Firm*—Laff, Whitesel, Conte & Saret

[57] ABSTRACT

The invention is directed to a dispensing unit which is secured to a support member by an expandable core. The dispensing unit includes a container which is capable of receiving an expandable core member to secure the dispensing unit to a support member. The expandable core member includes a cylinder which can be expanded outwardly to secure the dispensing unit to the support member.

6 Claims, 1 Drawing Sheet

PORTABLE TAPE DISPENSER UNIT

FIELD OF THE INVENTION

The invention generally relates to devices for dispensing material and to mechanisms for securing these devices to a support member and ultimately to a user's wrist.

BACKGROUND OF THE INVENTION

Dispensers for flexible materials such as tape are known in the art. These dispensers often require a high degree of manipulation since they are not fixedly secured to a support member. As a result, they require the user to employ both hands to operate the dispenser to retrieve material therefrom. Also, many applications for tape dispensers require the user to move from place to place to accomplish the job. For example, gift wrappers in department stores and package or container wrappers in the shipping departments of factories frequently walk to various locations within the department or warehouse, and therefore must carry their tools and tape dispensers with them. This can be inconvenient and cost time, particularly if the tape dispenser is misplaced. The devices of the prior art must be deliberately transported by the user, and in a situation where the user is very busy, are inefficient and awkward to use.

A need therefore exists for a dispensing device which can be easily secured in place, is capable of efficient material distribution without the high degree of manipulation required of prior art dispensing devices and can be affixed to the user as the user moves from place to place.

SUMMARY OF THE INVENTION

The invention is directed to a device for dispensing material. The device includes a dispensing unit which is secured to a support member by an expandable and deformable core. The dispensing unit includes a container having a cavity for receiving the expandable core member. The support member may include a flexible material such as polypropylene which can be wrapped on or otherwise attached to the user's body. The flexible material may include Velcro or other hook and loop type fasteners for securing the support member and attached dispensing unit in a desired position on the body.

The expandable core employed to secure the dispensing unit to the support member includes a cylinder which is expandable and distendable within the cavity of the container of the dispensing unit. The cylinder of the expandable core has a central opening there through for receiving a threaded bolt having a washer and a threaded nut thereon. The washer is in contact with the surface of the cylinder, whereby tightening of the nut against the surface of the washer causes the cylinder to expand radially outward in a direction normal to the bolt so as to affix the container and dispensing unit to the support member.

DETAILED DESCRIPTION OF THE INVENTION

The dispensing device of the invention and its manner of function will now be explained in detail by reference to the drawings wherein like numerals refer to like components.

Figure 3:
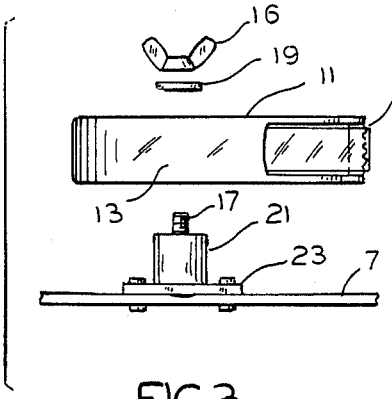
FIG. 3 is an exploded view of the dispensing device showing the dispensing unit, expandable core, and a support member.
Figure 2:
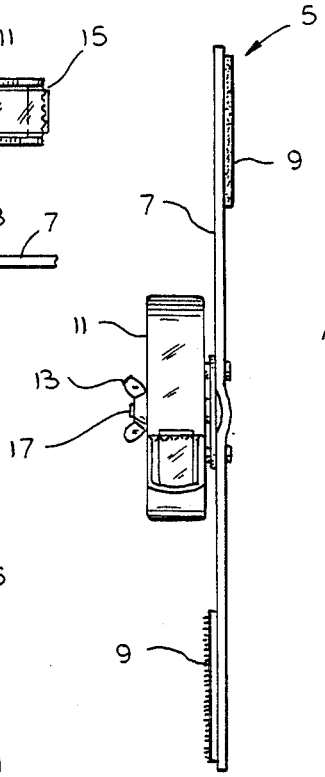
FIG. 2 is a side view of the dispensing device showing the dispensing unit mounted on a support member.
Figure 1:
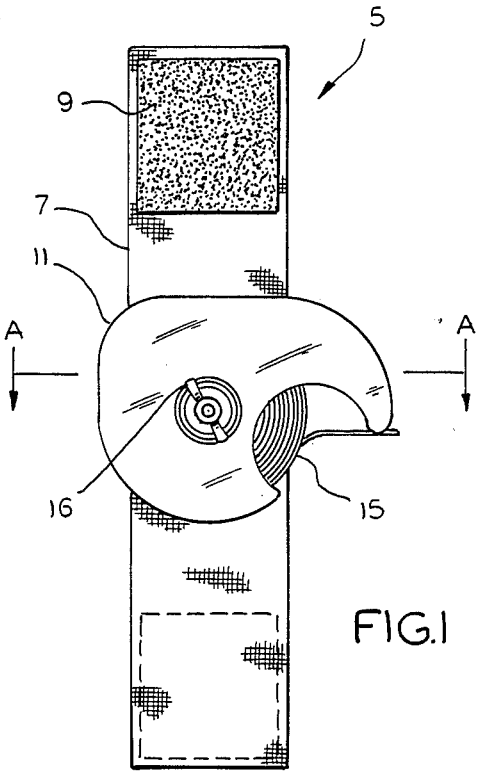
FIG. 1 is a top view of the dispensing device showing the dispensing unit mounted on a support member.

The dispensing device is generally shown at 5 in FIG. 1 and FIG. 2. Dispensing device 5 includes dispensing unit or container 11 having flexible material 15 therein. Dispensing unit 11, as shown in FIG. 3 and FIG. 6, includes a central cavity 13 for receiving expandable core member 33 for securing unit 11 to support member 7.

Figure 5:
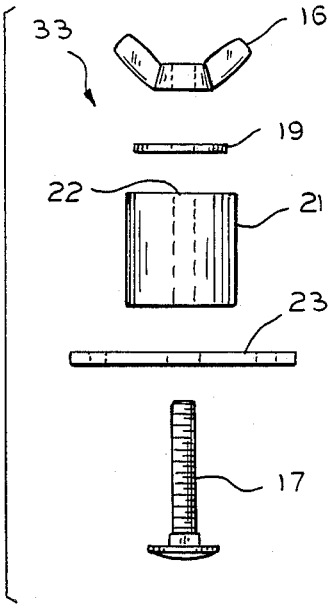
FIG. 5 is an exploded view of the expandable core for securing the dispensing unit to the support member.
Figure 6:
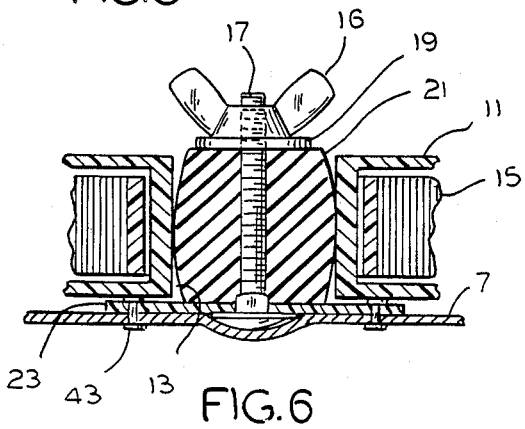
FIG. 6 is a partial cross-sectional view of the dispensing device taken along line A—A of FIG. 1.
Figure 7:
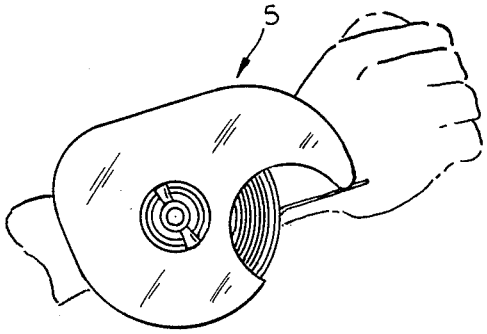
FIG. 7 is a top view of the dispensing device mounted on the arm of a user.

Expandable core member 33, as illustrated in FIG. 5 and FIG. 6, is attached to support member 7 by support plate 23 and pins 43. Pins 43 may include, for example, conventional double bottom or star rivets. Expandable core member 33 includes cylinder 21 having a hollow cavity 22 for receiving threaded bolt 17. Bolt 17 passes through cylinder 21 to receive washer 19 and threaded thumb nut. 16.

Support member 7 includes flexible materials which are capable of being adapted to a variety of configurations. Flexible materials suitable for use in support member 7 include polypropylene. Of course, other materials may be employed which are preferably capable of being formed into flexible straps or similar configurations suitable for attachment to a user, to a user's clothing, or to another surface, as would be appreciated by those skilled in the art.

Figure 4:
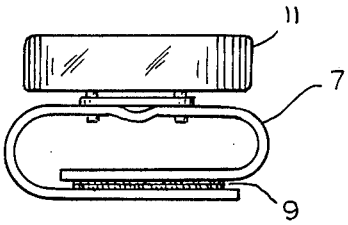
FIG. 4 is a side view of the dispensing device showing the support member in a closed configuration.

As shown in FIG. 4, support member 7 may be secured in a desired position by fasteners 9. Various types of fasteners 9, such as, for example, Velcro strips or other hook and loop type fasteners, snaps and buttons may be employed to secure support member 7 in a desired position.

Dispensing unit 11, as shown in FIG. 6, is secured to support member 7 by positioning the cavity 13 of dispensing unit 11 around cylinder 21. Thereafter, nut 16 is tightened against washer 19 on cylinder 21 to cause cylinder 21 to expand outwardly or radially against one or more surfaces of the cavity to secure unit 11 to support 7. Cylinder 21 includes resilient materials, such neoprene, which are capable of expanding laterally outwardly to contact the walls of cavity 13 of unit 11 during manual tightening of nut 16. Of course, other materials which are capable of expanding laterally outwardly during manual tightening of nut 16 may be employed, such as EPDM or SBR, alone or in combination with natural rubber. Desirably, the resilient material is of a hardness of 40 durometer, but material in the range of 30–60 durometer can also be used. Also, in place of a cylinder, other configurations can be used, provided that they can be expanded to at least partially contact and frictionally engage the walls of cavity 13.

Use of expandable core 33 permits the rapid and easy affixation of dispensing unit 11 to support 7. The outward, lateral expansion of clyinder 21 during tightening of nut 16 generates pressure and friction between the walls of cylinder 21 and cavity 13. The resulting frictional forces enable the user to secure dispensing unit 11 in a desired position on support 7. Support plate 23 provides a rigid surface beneath the cylinder 21 to permit tightening of the nut and to facilitate the longitudinal compression and radial expansion of the cylinder. This plate is preferably of a lightweight plastic material, such as Lexan.

The diameter of washer 19 should not be larger than the diameter of cavity 13 and should not be smaller than about 67% of the diameter of cylinder 21 in its relaxed state. When compressed, the cylinder should expand beyond the diameter of the washer. In one embodiment, the cylinder was three-quarters of an inch in diameter, the washer was five-eighths of an inch in diameter, and the cavity 13 was three quarters of an inch in diameter. In another embodiment, the cylinder and cavity were seven-eighths of an inch in diameter, while the washer was five-eighths of an inch. In general, the diameters of the cylinder and cavity should match, and they should mate in a slip fit.

Also, thumb nut !6 is ideally a wing nut, having a wing span or maximum diameter less than the diameter of cavity 13. This permits removal of securing unit 11 for replenishment of material 15 without the need for releasing support member 7. By relaxing cylinder 21, the securing unit 11 can be slid off of the cylinder, refilled with tape or other material, and secured again to support member 7 without ever having to remove support member 7.

Device 5, being comprised of support member 7 formed from flexible materials and expandable core 33, enables the user to readily secure dispensing unit 11 to, for example, the user's arm, wrist, belt, pants loop, or other location on the body or clothing. As such, the user is able to extract material 15 from unit 11 with only one hand, and the user can keep the hand and arm to which the dispensing unit is attached on loose work. The user is therefore able to efficiently extract material 15 from unit 11 with a minimal degree of manipulation and distraction relative to the devices of the prior art.

Furthermore, the invention permits the user to rotate the dispensing unit 11 around the axis formed by bolt 17 so as to present the material 15 in the most convenient position for the user. For example, left and right handed persons may prefer to have the unit in different positions. Also, since device 5 can be secured to the user, if desired, it is not easily misplaced and is usually conveniently and proximately located to the user.

The foregoing invention has been described with particular reference to use with flexible materials. However, the invention is not so limited. As such, various structural changes ma be made to the inventive dispensing device without departing from the scope of the invention.

I claim:

1. A device for retaining a dispenser of material and attaching it to its user, said dispenser having a cavity and cavity walls therein, comprising:

support means attachable to the user for supporting said dispenser;

a resilient core attached to said support means and extending into said dispenser cavity, said core comprising a cylinder which is deformable toward said cavity walls;

means for deforming said core so that it frictionally engages said dispenser and fixedly joins said dispenser to said support means, said deforming means comprising a threaded bolt running through said core and a threaded nut thereon, whereby tightening of said nut against said core on said threaded bolt causes said core to distend radially from said bolt.

2. The device of claim 1 wherein said cylinder of said core is neoprene.

3. The device of claim 1 wherein the material of said cylinder of said core has a resiliency of about 40 durometer.

4. The device of claim 1 wherein said core has a hollow cavity there through for said bolt.

5. A holder for a tape dispenser which can be secured to a user as the user moves from place to place, said dispenser holding a rotatable roll of tape and having a cavity formed by the walls of the dispenser, said holder comprising:

a resilient member within said cavity, means for applying pressure to said resilient member so that at least a portion of said resilient member deforms against and frictionally engages said cavity walls, thereby locking said member to said dispenser, and a flexible strap attached to said resilient member, said strap capable of being removably affixed to a user, wherein said dispenser is rotatable around said resilient member until locked into the desired position by said pressure means.

6. A holder for a tape dispenser which can be secured to a user as the user moves from place to place, said dispenser holding a rotatable roll of tape and having a cavity formed by the walls of the dispenser, said holder comprising:

a resilient member within said cavity;

a flexible strap attached to said resilient member, said strap capable of being removably affixed to a user;

means for applying pressure to said resilient member so that at least a portion of said resilient member deforms against and frictionally engages said cavity walls, thereby locking said member to said dispenser, said pressure means including a rigid support plate attached to said strap, a threaded bolt extending through said support plate and said resilient member, and a corresponding nut positioned on said bolt so that said resilient member is between said support plate and said nut, whereby tightening said nut on said threaded bolt distends said resilient member against said cavity walls.

* * * * *